US005147207A

United States Patent [19]

Mowry

[11] Patent Number: 5,147,207

[45] Date of Patent: Sep. 15, 1992

[54] BALANCED PRESSURE CONNECTOR

[75] Inventor: Thomas E. Mowry, Cardiff, Calif.

[73] Assignee: Teledyne Kinetics, San Diego, Calif.

[21] Appl. No.: 740,856

[22] Filed: Jul. 30, 1991

Related U.S. Application Data

[63] Continuation of Ser. No. 605,491, Oct. 30, 1990, abandoned.

[51] Int. Cl.[5] ..... H01R 9/09

[52] U.S. Cl. ..... 439/66; 439/74; 439/591

[58] Field of Search ..... 439/66, 74, 591, 75

[56] References Cited

U.S. PATENT DOCUMENTS

| | | | |
|---|---|---|---|
| 3,551,750 | 12/1970 | Sterling | 439/66 |
| 3,954,317 | 5/1976 | Gilissen et al. | 439/66 |
| 4,057,311 | 11/1977 | Evans | 439/66 |
| 4,636,018 | 1/1987 | Stillie | 439/66 |
| 5,013,249 | 5/1991 | Lindeman et al. | 439/75 |
| 5,037,311 | 8/1991 | Frankeny et al. | 439/66 |

OTHER PUBLICATIONS

Burndy, Advertisement Entitled *Qikstack Feed-Thru Stacking Connectors,* no date.

PCK Elastomerics, Inc. Advertisement Entitled *Parallel Board Connector,* no date.

Advertisement Entitled *Zone 3 Connectors,* no date.

Ufheil, Joseph C., *Compression Mount Technology for Surface Mate Connectors,* pp. 633-645, no date.

Tecknit, Advertisement re *Zebra, the New Connector Technology,* Dated Apr. 1982.

Method Electronics, Inc. Advertisement Entitled *Surface Mate Surface Compression Connectors,* 1989.

PCNetwork, Advertisement Entitled *SMT Connectors for High Denisty Packaging, p. 33, Aug. 1990.*

PCNetwork, Advertisement Entitled *130-Contact Connector Enhances Multibus II Board Connections,* p. 34, Aug. 1990.

*Primary Examiner*—Paula A. Bradley

*Attorney, Agent, or Firm*—Nydegger & Associates

[57] ABSTRACT

An electrical connector for engaging a plurality of contact beams with an electronic substrate includes an elongated support body on which the contact beams are individually attached as cantilevers. A plurality of mounting points are formed on the support body to separate the contact beams into segments, and are used for holding the electrical connector against the substrate. Importantly, the contact beams are separated into segments which are of either a first length or a second length. Preferably, in order to more effectively balance the distributed load of the electrical connector against the electronic substrate, the first length is approximately one third the second length and the segments of first length are located at the ends of the support body.

12 Claims, 2 Drawing Sheets

BALANCED PRESSURE CONNECTOR

This is a continuation of co-pending application Ser. No. 605,491 filed on Oct. 30, 1990, now abandoned.

FIELD OF THE INVENTION

This invention relates generally to electrical connectors. More specifically, this invention relates to electrical connectors which are useful for engaging a plurality of contact beams with an electronic substrate. The present invention is particularly, but not exclusively, useful for balancing the distributed load which results on an electronic substrate when a plurality of aligned contact beams are electrically engaged with the electronic substrate.

BACKGROUND OF THE INVENTION

As is well-known in the mechanical arts, any structure or body which is subjected to known or identifiable forces will tend to deform or deflect in a predictable manner. As with any other solid structures, this also holds true for electronic components which must be engaged with each other to establish desired electrical circuits. Electronic components, however, are of a unique concern because any unwanted deformation or deflection of an electronic component can result in unconnected or misconnected electrical circuits. Accordingly, the interest here focuses on some of the problems which are caused by structural deformations or deflections of interconnected electronic components. More specifically, the concern here is on the deformations or deflections of an electronic substrate, such as a printed circuit board, which occur when the substrate is engaged with a plurality of electrical contacts to establish desired electrical circuits.

Typically, an electronic substrate supports a complex of electrical circuits which are collectively or individually connected with electrical circuits external to the substrate. Frequently, such connections are with two or more other electronic substrates. In any event, it is normally the case that the electrical circuits on a substrate terminate at electrical pads which are located on a peripheral edge of the substrate. In most instances the edge of the substrate is linear and these pads are, therefore, typically aligned along the edge. Consequently, the connector which is used to establish electrical contact between electrical circuits on the substrate and electrical circuits which are external to the substrate is an elongated member that is engageable with the pads at the edge of the substrate.

Connectors which establish electrical connections with the substrate as mentioned above are generally elongated structures which support a plurality of cantilevered contact beams. Further, it is the normal practice to attach these elongated connectors to the substrate at points which are at, or very near, the ends of the elongated structure. The result upon attachment of the connector with the substrate is that the forces exerted by the connector on the substrate can be easily characterized. Specifically, the force distribution on the substrate for such an attachment includes concentrated loads at the end points where the elongated structure is attached to the substrate and a uniformly distributed load between the concentrated loads which is caused by the individual cantilevered contact beams urging against the pads on the substrate.

With a load distribution as described above, it is known that the substrate will respond in a predictable manner. Specifically, the substrate will bow across the distance under the uniformly distributed load and between the end points where it is subjected to the concentrated load. This bowing of the substrate, however, can have an adverse effect for the electrical connection between the contact beams on the elongated structure and the pads on the substrate. For instance, it is known in the electrical arts that there needs to be some minimal force between the contact beam and the substrate pad in order for there to be an effective electrical connection. If the substrate is bowed, however, the deflection of the substrate will distance the substrate from the elongated structure and thereby reduce the interactive force between the substrate and the contact beams cantilevered on the elongated structure. Thus, the required force for an effective electrical connection can not be insured and, indeed, may not be attained.

The present invention recognizes that whenever an electronic substrate and a series of spring-loaded, or cantilevered, contact beams are connected together, the result will be a distributed load on the substrate. The present invention further recognizes that any distributed load in combination with a concentrated load, or loads, will tend to bow or bend the substrate. The present invention, however, also recognizes that the distribution of uniform and concentrated loads between an electrical connector and an electronic substrate can be engineered to minimize the bowing of the substrate and, thus, enhance the electrical connections between these two structures.

In light of the above, it is an object of the present invention to provide a connector for balancing the forces between a plurality of electrical contact beams on a connector and a plurality of electrical pads on an electronic substrate, to establish a more secure electrical connection between the contact beams and the substrate. It is another object of the present invention to provide a balanced pressure connector which more evenly urges electrical contact beams into electrical contact with an electronic substrate in order to reduce or minimize deflections of the substrate. Yet another object of the present invention is to provide a balanced pressure connector which is simple to use, relatively easy to manufacture, and comparatively cost-effective.

SUMMARY OF THE INVENTION

A connector for electrically engaging a contact beam with an electronic substrate, in accordance with the present invention, comprises an elongated support for holding a plurality of cantilevered contact beams in juxtaposed alignment. The support is formed with a plurality of mounting points which permit engagement of the contact beams on the support with the electronic substrate. Further, the mounting points are located along the length of the support to divide the contact beams into segments. Importantly, each mounting point is bracketed or straddled by segments of contact beams and each segment is of either a first length of predetermined distance or a second length which is approximately two to three times as long as the first length. Additionally, the support can be formed with a datum post which is engageable with the electronic substrate to electrically connect the segments of contact beams on the support with the electrical pads on the substrate.

In an alternate embodiment of the present invention, the support of the connector is formed to hold a plurality of lines of contact beams. More specifically, each line of contact beams has segments of contact beams which are positioned for engagement with electrical pads on a respective substrate. For example, the connector can have opposed lines of contact beams which are respectively engageable with substantially parallel electronic substrates when the connector is positioned between the substrates. In any embodiment of the present invention, there can be as many mounting points as desired.

The novel features of this invention, as well as the invention itself, both as to its structure and its operation will be best understood from the accompanying drawings, taken in conjunction with the accompanying description, in which similar reference characters refer to similar parts, and in which:

DESCRIPTION OF THE PREFERRED EMBODIMENTS

Figure 1:
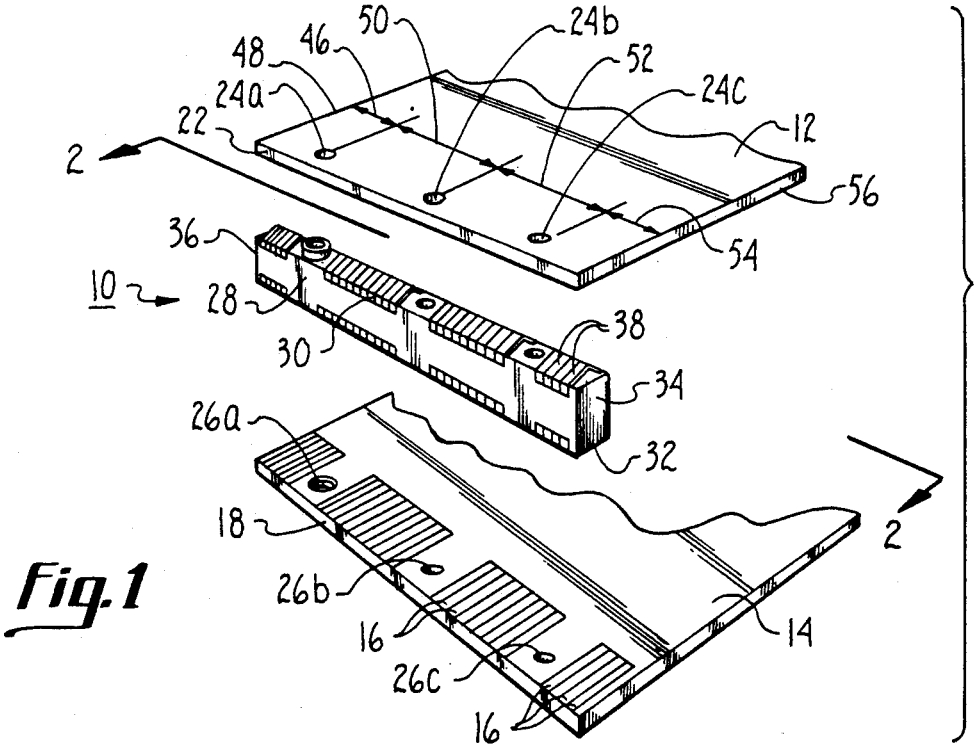
FIG. 1 is a rear perspective view of the balanced pressure electrical connector of the present invention shown in an exploded relationship with parallel disposed electronic substrates.

Referring initially to FIG. 1, a balanced pressure connector in accordance with the present invention is shown and generally designated 10. As shown, the connector 10 is positioned between an electronic substrate 12 and an electronic substrate 14 for engagement or attachment therewith. Although FIG. 1 indicates connector 10 is engageable with two different substrates, it is to be appreciated that the connector 10 may be engaged to only one substrate or to more than two substrates without departing from the intent of the present invention.

To consider the substrates 12, 14 for the moment, it will be seen that substrate 14 is formed with a series of electrical pads 16 which are positioned along the peripheral edge 18 of the substrate 14. Though not shown in FIG. 1 (in fact they are shown only in FIG. 2), a series of electrical pads 20 are also positioned along the peripheral edge 22 of substrate 12. In all respects the pads 20 are similar to the pads 16 and each are formed on their respective substrates 12, 14 to provide connections with electrical circuits on the substrates 12, 14. FIG. 1 also shows that the substrate 12 is formed with a plurality of attachment points 24 *a, b,* and *c* which provide means for engaging or attaching the substrate 12 to connector 10. Likewise, the substrate 14 is formed with a plurality of attachment points 26 *a, b,* and *c* which provide means for engaging or attaching the substrate 14 to connector 10. As contemplated for the present invention, the substrates 12 and 14 can be of any type electronic substrate well-known in the pertinent art, such as a printed circuit board which is typically made of a ceramic material.

Figure 2:
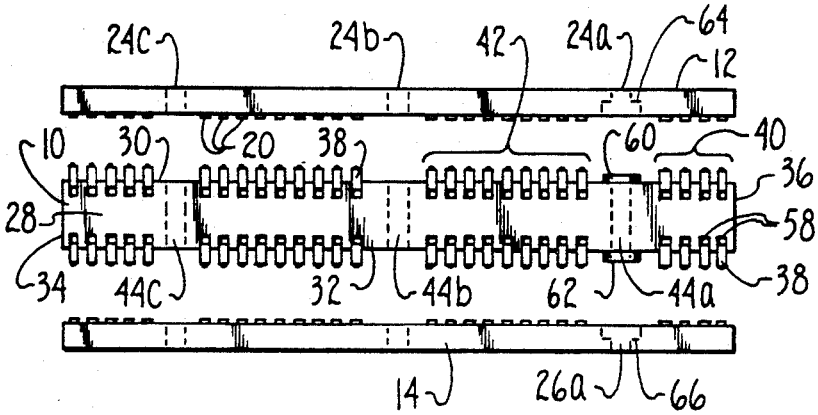
FIG. 2 is a front elevational view of the connector of the present invention in its exploded relationship with parallel substrates as seen along the line 2—2 in FIG. 1.
Figure 3:
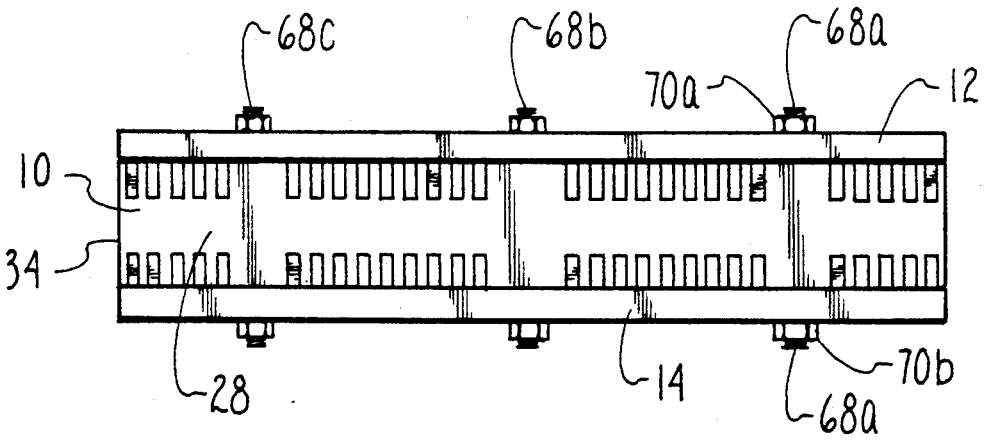
FIG. 3 is a front elevational view of the connector of the present invention as seen in FIG. 2 with the connector engaged with the substrates.

The connector 10 is shown in FIG. 1 to comprise an elongated support body 28 which is configured to have a substantially rectangular cross section. Accordingly, the support body 28 has a surface 30 and a surface 32, which is opposed to the surface 30, and both the surface 30 and the surface 32 extend between the ends 34 and 36 of support body 28. As shown in FIGS. 1, 2 and 3, the connector 10 has a plurality of contact beams 38 which are positioned in juxtaposed alignment along each of the surfaces 30 and 32. More specifically, each contact beam 38 is attached or anchored on the support body 28 as a cantilever. The method for attaching contact beams 38 to the support body 28 can be accomplished in any manner well-known in the pertinent art, such as by integrally molding the contact beams 38 into the support body 28. Importantly, however, the attachment of contact beams 38 onto support body 28 must allow sufficient flexibility for the contact beams 38 to deflect upon engagement of the connector 10 with substrates 12, 14. Further, the material used for the manufacture of contact beams 38 must provide these structures with sufficient rigidity for the beams 38 to make effective electrical contact with the substrates 12, 14.

As perhaps best seen in FIG. 2, the contact beams 38 are attached to the support body 28 in segments, of which the segments 40 and 42 are only exemplary. Further, as shown in FIG. 2, the support body 28 is formed with a plurality of mounting points 44 *a, b,* and *c* which are formed as holes on the support body 28 and which separate the segments of contact beams 38 that are attached to the body 28. For example, mounting point 44*a* is positioned on support body 28 to be between the segments 40 and 42. Stated differently, segments 40 and 42 straddle or bracket the mounting point 44*a*. This bracketing or straddling relationship of the segments and the mounting points 44 *a, b* and *c* is maintained along the length of the support body 28 regardless how long the support body 28 may be or how many mounting points 44 may be formed on the support body 28.

Referring for the moment to FIG. 1, it will be seen that the attachment point 24*a* on substrate 12 is located at a distance 46 from the side edge 48 of substrate 12. Further, the attachment point 24*a* is located a distance 50 from attachment point 24*b*, the attachment point 24*b* is located a distance 52 from attachment point 24*c* and, finally, the attachment point 24*c* is located a distance 54 from the side 23 edge 56 of substrate 12. Importantly, the intermediate distances between adjacent attachment points, e.g., the distances 50 and 52, are approximately two to three times as long as the distances between the end attachment points and their adjacent side edges, e.g., the distances 46 and 54. As can be appreciated with cross reference between FIG. 1 and FIG. 2, the mounting points 44*a, b* and *c* are located along the length of support body 28 such that segment 40 of contact beams 38 corresponds to the distance 46, segment 42 corresponds to the distance 50 and, indeed, all segments of contact beams 38 correspond to a distance between respective attachment points 24 on substrate 12. For the engagement of connector 10 with the substrate 14, the same structural compatibility applies as set forth above for the engagement of connector 10 with the substrate 12.

As indicated above, the contact beams 38 are mounted on support body 28 as cantilevers. Consequently, engagement of connector 10 with substrate 12 or 14 will cause the contact beams to deflect. To account for this deflection, the connector 10 is formed with a series of slots 58 which are respectively positioned on the support body 28 to receive a deflected contact beam 38. This structure is, perhaps, best seen in FIG. 2 where it will also be seen that the support body 28 of connector 10 is formed with a datum post 60 and a datum post 62. More specifically, the datum posts 60, 62 are respectively formed around the opposed openings of mounting point 44*a*. FIG. 2 also shows that the attachment point 24*a* of substrate 12 is formed with a recess 64 for receiving the datum post 60 and that the attachment point 26*a* on substrate 14 is formed with a recess 66 for receiving the datum post 62. With this structure, whenever connector 10 is engaged with substrate 12, the interaction of datum post 60 with recess 64 will index or register the contact beams 38 with the proper pads 20 on substrate 12. Similarly, whenever connector 10 is engaged with substrate 14 the interaction of datum post 62 with recess 66 will properly index or register the connector 10 with the electrical pads 16 on substrate 14.

FIG. 3 shows the connector 10 engaged with both the substrate 12 and the substrate 14. As shown, it is to be appreciated that for this engagement a bolt 68*a* is inserted through attachment point 24*a* of substrate 12, through mounting point 44*a* of support body 28, and through the attachment point 26*a* of substrate 14. The bolt 68*a* is then held in place by nuts 70*a*, and *b* as shown. Similarly, bolts 68*b* and 68*c* are inserted through respective attachment points and mounting points to provide more effective engagement of the substrates 12 and 14 with the connector 10. While bolts 68*a*, *b* and *c* have been disclosed here as the means for connecting substrates 12 and 14 with the connector 10 it will be appreciated by the skilled artisan that any means well-known in the pertinent art can be used for engaging the connector 10 with the substrates 12 and 14. In any event, the engagement of connector 10 with the substrates 12 and 14 creates forces on the respective substrates which tend to deform the substrates 12 and 14, and separate the beams 38 from their intended contact with the appropriate electrical pads. A brief analysis of these forces and the result they have on the efficacy of the connector 10 is helpful for understanding the cooperation of structure intended for the present invention. For this purpose, reference is made to FIGS. 4A and 4B.

Figure 4A:
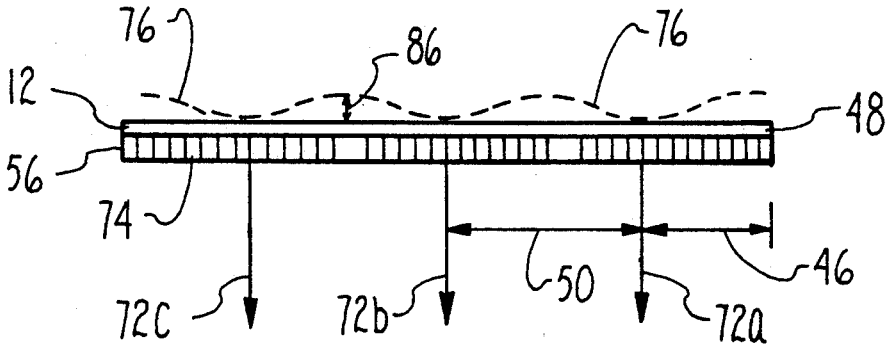
FIG. 4A is a load diagram representing the loading configuration imposed on a substrate by a connector of the present invention and the resultant deflection diagram for the substrate superimposed thereon.

In FIG. 4A only the substrate 12 is shown. It is to be appreciated, however, that the discussion here applies equally to other substrates, such as the substrate 14. As shown, upon engagement of the connector 10 with the substrate 12, substrate 12 is subjected to the concentrated loads 72*a*, *b* and *c* which result from the respective actions of the bolts 68*a*, *b* and *c* against the substrate 12. Additionally, a distributed load 74 effectively acts against the substrate 12 from edge 48 to edge 56 as a result of the contact beams 38 urging against the substrate 12. Importantly, the concentrated loads 72 are bracketed or straddled by the distributed load 74. Specifically, and by way of example, the concentrated load 72*a* is located a distance 46 from the edge 48 and is located a distance 50 from its adjacent concentrated load 72*b*. For purposes of the present invention, distance 50 is in a range of approximately two to three times as long as the distance 46. Indeed, it is preferable that each concentrated load is approximately two to three times as far from an adjacent concentrated load as are the end concentrated loads from their nearest edge. The result, according to well-known engineering analysis, is that the substrate 12 will be deformed from an unstressed configuration, as shown, into a shape which, though somewhat exaggerated, is indicated in FIG. 4A by the line 76.

Figure 4B:
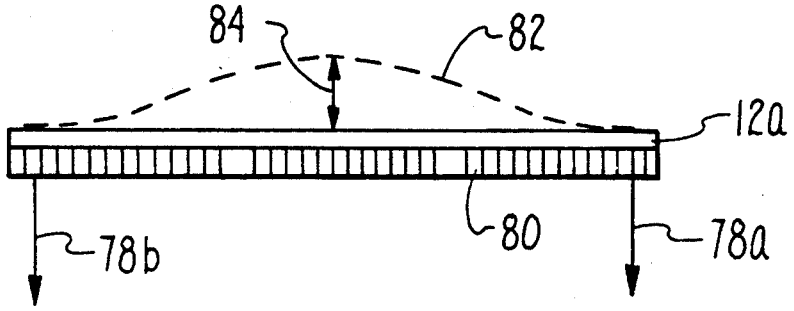
FIG. 4B is a load diagram represent the loading configuration imposed on a substrate by a conventional connector and the resultant deflection diagram for the substrate superimposed thereon.

For comparison purposes, FIG. 4B shows a substrate 12*a* which is attached to an electronic connector in the conventional manner with the engagement points being at or very near the edges of the substrate 12*a*. The resultant forces on the substrate 12*a* from this engagement are a pair of concentrated loads 78*a* and 78*b* which are located near the edges of the substrate. Additionally, a distributed load 80 extends between the concentrated loads 78*a* and 78*b* as a consequence of the connectors contact beams urging against the substrate. The result, again according to well-known engineering analysis, is that the substrate 12*a* will be deformed from an unstressed configuration as shown, into a shape which is indicated in FIG. 4B by the line 82. Though line 82 is also somewhat exaggerated, it is relatively proportional to the line 76. In comparison, it will be seen that the maximum deflection 84 which results from the loading caused by a conventional electronic connector is significantly greater than a maximum deflection 86 which results from the engagement of connector 10 with a substrate 12. Consequently, because the deformation or deflection of substrate 12 is lessened when a connector 10 is used, the forces by which contact beams 38 urge against respective pads 16, 20 is more balanced. Thus, the electrical connections are more predictable and reliable.

While the particular balanced pressure connector as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

I claim:

1. A connector for electrically engaging a contact beam with an electronic substrate which comprises:

a support body for holding a plurality of said contact beams in juxtaposed alignment said support body having a first end and a second end;

a plurality of mounting points formed on said support body for mounting said support body on said substrate, said mounting points being positioned on said support body to divide said support body into segments, each said segment holding a plurality of said contact beams and each said segment having either a first length or a second length with one said mounting point being distanced said first length from said first end and another said mounting point being distanced said first length from said second end to cantilever said first end and said second end of said support body, said first length being more than approximately one third said second length; and means for fastening said support body to said substrate at said mounting points, said fastening means thereby applying concentrated loads to said substrate at said mounting points.

2. A connector as recited in claim 1 wherein each of said contact beams is mounted on said support body as a cantilever.

3. A connector as recited in claim 1 wherein at least one of said mounting points further comprises a datum post engageable with said substrate to electrically connect said segments of said contact beams with electrical pads on said substrate.

4. A connector as recited in claim 1 wherein each said fastening means is a bolt and nut coupling.

5. A connector as recited in claim 1 wherein said support body is an elongated member having a first end and a second end and having a substantially rectangular cross section to establish a first surface and an opposed second surface intermediate said first and second ends, and wherein said segments of contact beams having said first length are adjacent said first end and said second end of said support body.

6. A connector as recited in claim 5 wherein said segments of said contact beams having said second length are intermediate any two of said mounting points.

7. A connector as recited in claim 6 wherein said aligned contact beams are mounted on said first surface of said support body to form a first line of contacts and said connector further comprises a plurality of contact beams mounted on said second surface of said support body in juxtaposed alignment to form a second line of contacts, said contact beams in said second line being respectively opposed to said contact beams in said first line.

8. A connector for balancing the pressures of engagement between a plurality of electrical contact beams and a plurality of electrical pads on an electronic substrate which comprises:

an elongated support body for holding said plurality of contact beams, said support body having a first end and a second end;

a plurality of mounting points including a first end mounting point and a second end mounting point, said mounting points being located on said support body with said mounting points separated from each other by a predetermined distance, and with said first end mounting point approximately one third said predetermined distance from said first end with a plurality of said contact beams held therebetween to cantilever said first end of said support body, and said second end mounting point distanced approximately one third said predetermined distance from said second end with a plurality of said contact beams held therebetween to cantilever said second end of said support body; and means for fastening said support body to said substrate at said mounting points, said fastening means thereby applying concentrated loads to said substrate at said mounting points.

9. A connector as recited in claim 8 wherein each said fastening means is a bolt and nut coupling.

10. A connector as recited in claim 8 wherein said contact beams are aligned on said support body to form a first line of contacts and said connector further comprises a plurality of contact beams mounted on said support body in juxtaposed alignment to form a second line of contacts, said contact beams in said second line being respectively opposed to said contact beams in said first line.

11. A connector as recited in claim 10 wherein each of said contact beams is mounted on said support body as a cantilever.

12. A connector as recited in claim 11 wherein at least one of said mounting points further comprises a datum post engageable with said substrate to electrically connect said segments of said contact means with electrical pads on said substrate.

* * * * *